US007358919B2

(12) United States Patent
Nagano

(10) Patent No.: US 7,358,919 B2
(45) Date of Patent: Apr. 15, 2008

(54) FEEDHORN, RADIO WAVE RECEIVING CONVERTER AND ANTENNA

(75) Inventor: Atsushi Nagano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/290,400

(22) Filed: Dec. 1, 2005

(65) Prior Publication Data

US 2006/0125705 A1 Jun. 15, 2006

(30) Foreign Application Priority Data

Dec. 10, 2004 (JP) ..... 2004-357831

(51) Int. Cl.
*H01Q 13/00* (2006.01)
*H01Q 1/42* (2006.01)

(52) U.S. Cl. ..... 343/786; 343/785; 343/872

(58) Field of Classification Search ..... 343/772, 343/781 R, 785, 786, 872
See application file for complete search history.

(56) References Cited

U.S. PATENT DOCUMENTS

| | | | | |
|---|---|---|---|---|
| 5,550,553 | A * | 8/1996 | Yamaki et al. | 343/785 |
| 6,501,432 | B2 * | 12/2002 | Yuanzhu | 343/772 |
| 7,075,496 | B2 * | 7/2006 | Hidai et al. | 343/786 |
| 2005/0140560 | A1 | 6/2005 | Nagano | 393/786 |

FOREIGN PATENT DOCUMENTS

| | | |
|---|---|---|
| JP | 2000-040914 | 2/2000 |
| JP | 2001-217644 | 8/2001 |

* cited by examiner

*Primary Examiner*—Shih-Chao Chen
(74) *Attorney, Agent, or Firm*—Nixon & Vanderhye, P.C.

(57) ABSTRACT

A feedhorn includes a chassis body, a waterproof cover serving as a cover member and a dielectric antenna. The chassis body includes a waveguide having an opening. The waterproof cover is connected to the chassis body to close the opening. The waterproof cover is made of a dielectric. The dielectric antenna is placed to face the opening with the waterproof cover therebetween. Thus, the feedhorn, a radio wave receiving converter and an antenna with which the manufacturing cost can be reduced are achieved.

17 Claims, 5 Drawing Sheets

FEEDHORN, RADIO WAVE RECEIVING CONVERTER AND ANTENNA

This nonprovisional application is based on Japanese Patent Application No. 2004-357831 filed with the Japan Patent Office on Dec. 10, 2004, the entire contents of which are hereby incorporated by reference.

BACKGROUND OF THE INVENTION

1. Field of the Invention

The present invention relates to a feedhorn, a radio wave receiving converter and an antenna, and particularly to a feedhorn having a dielectric antenna, a radio wave receiving converter and an antenna.

2. Description of the Background Art

An antenna for receiving radio waves of satellite broadcasting or the like has been known. A radio wave receiving converter is utilized in conjunction with the antenna. As a component of the radio wave receiving converter, a feedhom having a dielectric antenna connected to an open end of a waveguide has been known (see for example Japanese Patent Laying-Open No. 2001-217644).

Japanese Patent Laying-Open No. 2001-217644 discloses that a part of the dielectric antenna is press-fit within the internal periphery of the open end of the waveguide so as to connect and fix the dielectric antenna to the waveguide.

Regarding the feedhorn having the above-described structure, however, high dimensional precision of the internal periphery of the waveguide and the aforementioned part of the dielectric antenna must be maintained. Otherwise, it is impossible to ensure reliability of the connecting portion connecting the waveguide and the dielectric antenna to each other. Further, if a change in ambient temperature causes the dielectric antenna to thermally expand or thermally contract, the strength of the connecting portion connecting the waveguide and the dielectric antenna could change. In this case as well, the reliability of the connecting portion deteriorates. As a result, the converter including the feedhorn as well as the antenna including this converter could deteriorate in reliability. In order to avoid occurrence of such problems, the inventor of the present invention conducted studies on the approach of tightly attaching, to the dielectric antenna, a cover member placed to cover the dielectric antenna and thereby pressing to fix the dielectric antenna to the waveguide.

In this case, however, if the dielectric antenna is changed in shape, the shape of the cover member has to be changed as well. For example, if feedhorns are to be mounted respectively on two types of parabolic antennas that are different for example in angular aperture and FD ratio, two types of radiation patterns of the feedhorns are also necessary. Therefore, dielectric antennas of two different types in shape are necessary as well. Further, two types of cover members are also necessary. Consequently, an increased number of molds are required for manufacturing feedhorns, which is a factor of an increase in manufacturing cost of the feedhorn.

BRIEF SUMMARY

The present technology provides a feedhorn, a radio wave receiving converter and an antenna, and in achieves a decrease manufacturing cost.

A feedhorn according to an example embobodiment includes a chassis body, a cover member and a dielectric antenna. The chassis body includes a waveguide having an opening. The cover member is connected to the chassis body to cover the opening. The cover member is made of a dielectric. The dielectric antenna is placed to be opposite to the opening with the cover member therebetween.

In an example embobodiment, a common cover member can be used for dielectric antennas different in shape from each other. Accordingly, the feedhorn manufacturing cost can be reduced as compared with the case where cover members are formed that have respective shapes different from each other to be appropriate for respective shapes of dielectric antennas.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic diagram showing an example embodiment of an antenna for receiving radio waves of satellite broadcasting or the like.

DETAILED DESCRIPTION

Figure 1:
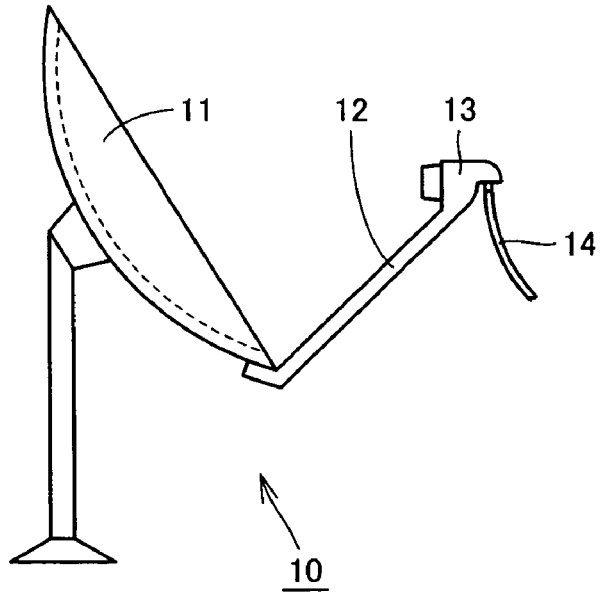

An example embodiment is hereinafter described in conjunction with the drawings. It is noted that like or corresponding components in the drawings are denoted by like reference characters and the description thereof is not repeated.

Figure 2:
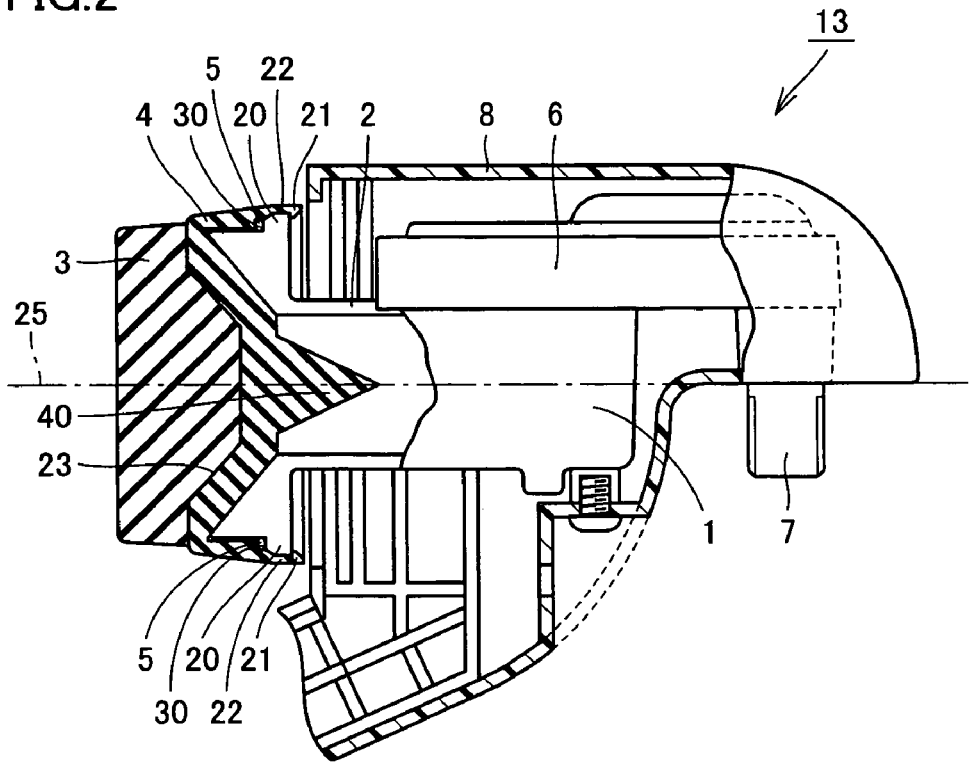
FIG. 2 is a schematic diagram showing a radio wave receiving converter used for the antenna shown in FIG. 1.

Referring to FIGS. 1 and 2, a description is now given of a converter having a dielectric feedhorn as well as a radio wave receiving antenna (hereinafter also referred to as antenna) according to example embodiment.

As shown in FIG. 1, an antenna 10 of the example embodiment includes a parabolic portion 11 for reflecting radio waves, an arm 12 connected to parabolic portion 11 and a converter 13 mounted on an end of arm 12 for receiving radio waves. To converter 13, a cable 14 for transmitting received radio waves (signal) to other components such as a tuner and a BS receiver is connected. As this cable 14, a coaxial cable for example may be employed. Further, on the rear side of parabolic portion 11, a support arm is attached that is a fixing support member for mounting and fixing antenna 10 at a predetermined location.

As shown in FIG. 2, converter 13 is comprised of a chassis body 1, a circuit portion 6 connected to chassis body 1, a waterproof cover 4 mounted to close an opening (front opening end) of a waveguide 2 provided to chassis body 1, a dielectric antenna 3 mounted in front of waterproof cover 4 (mounted at a position opposite to the opening of waveguide 2 with waterproof cover 4 therebetween), and an exterior cabinet 8 serving as an exterior member covering chassis body 1 and circuit portion 6. Exterior cabinet 8 has its lower portion connected to the end of arm 12 shown in FIG. 1. Further, on circuit portion 6, an output terminal 7 is formed for connecting cable 14 shown in FIG. 1.

Waterproof cover 4 closes the opening of waveguide 2 and includes a sidewall portion 22 extending over the side surface of chassis body 1 where waveguide 2 is formed. On an end of this sidewall portion 22, a nail portion 21 that is a protrusion protruding toward the inside of waterproof cover 4 is formed. Chassis body 1 has its sidewall (side surface) portion that is opposite to sidewall portion 22 of waterproof cover 4 and that has a flange portion 20 formed to protrude outward (in the direction away from a central axis 25). Nail portion 21 of waterproof cover 4 and a sidewall of flange portion 20 of chassis body 1 fit with each other (namely nail portion 21 fits with a depression formed by the sidewall of flange portion 20 and the external wall surface of chassis body 1) to fix waterproof cover 4 to chassis body 1. While nail portion 21 may be formed to extend all around the end of sidewall portion 22 of waterproof cover 4, nail portions may be formed at a plurality of positions (for example, two positions or at least three positions) of the end of sidewall portion 22. Further, a protrusion may be formed on chassis body 1 and a depression may be formed in waterproof cover 4.

In this case, preferably a plurality of nail portions 21 are arranged at even intervals in the circumferential direction of the end of sidewall portion 22 of waterproof cover 4. Further, while flange portion 20 of chassis body 1 may be formed all around the sidewall of chassis body 1, in the case where nail portions 21 of waterproof cover 4 are formed at a plurality of locations, flange portions 20 may be formed only at those locations opposite to these nail portions 21. Furthermore, in front of flange portion 20 of chassis body 1 (in front of a sidewall of flange portion 20 that is located opposite to the sidewall which is in contact with the protrusion of nail portion 21 of waterproof cover 4), a groove 30 is formed all around the sidewall of chassis body 1. In this groove 30, a ring packing 5 is inserted. As shown in FIG. 2, in the state where waterproof cover 4 is connected and fixed to chassis body 1, ring packing 5 is pressed against and tightly attached to each of the internal surface of waterproof cover 4 and the internal surface of groove 30 of chassis body 1. Accordingly, ring packing 5 can be used to separate, from the external space of converter 13, the internal space (space inside waveguide 2) surrounded by chassis body 1 and waterproof cover 4. Thus, favorable airtightness of the internal space of waveguide 2 can be maintained.

On the front side of waterproof cover 4, a concave portion 23 is formed. Dielectric antenna 3 is mounted to cover this concave portion 23. Dielectric antenna 3 is mounted to be attachable to and detachable from waterproof cover 4. How to connect dielectric antenna 3 to waterproof cover 4 is herinafter described. Preferably, dielectric antenna 3 and waterproof cover 4 are made of the same material for preventing mismatching therebetween. For example, as a material of which dielectric antenna 3 and waterproof cover 4 are made, polyethylene, polypropylene, polystyrene or Teflon (registered trademark) for example may be employed. Since these materials are low in dielectric loss (tanδ), they are preferable materials in that the transmission loss can be kept low.

In this way, dielectric antenna 3 is mounted to be attachable to and detachable from the outside of waterproof cover 4 and thus dielectric antenna 3 can arbitrarily be replaced with any that is appropriate for such elements of a parabolic antenna as angular aperture and FD ratio. Accordingly, converter 13 with general versatility can be obtained and thus the manufacturing cost of converter 13 can be reduced.

Figure 9:
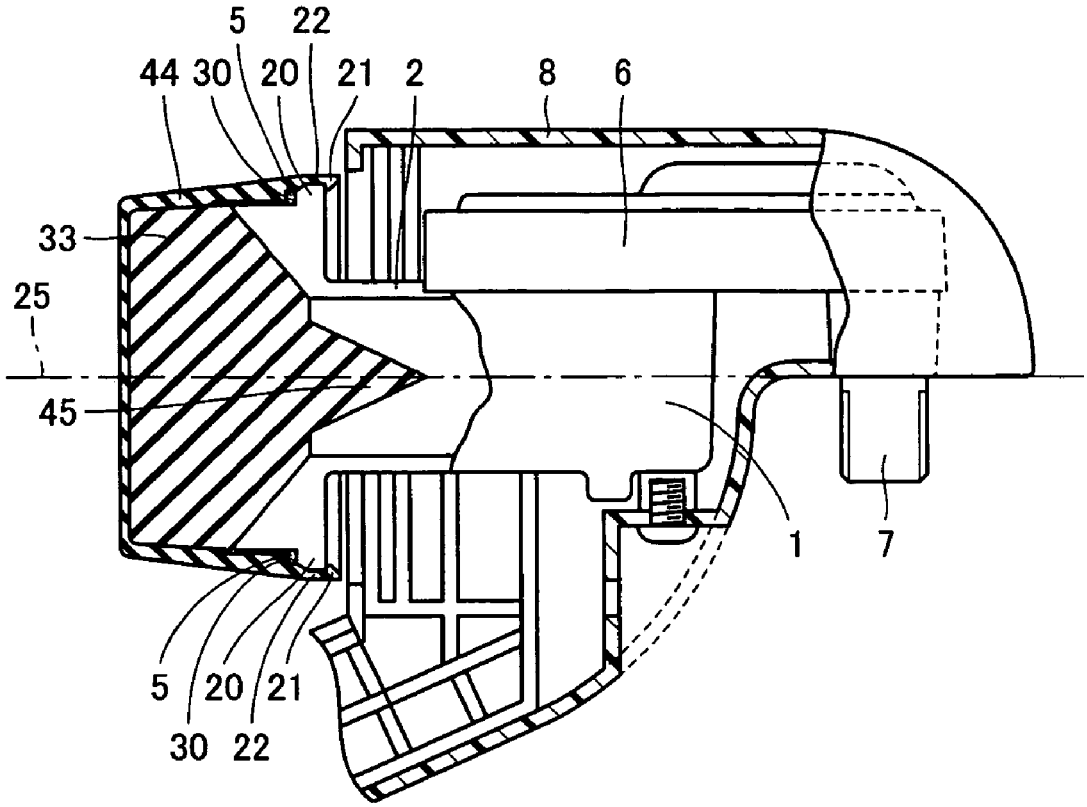
FIG. 9 is a schematic diagram showing a converter as a comparative example for describing effects of the antenna and the converter shown in FIGS. 1 and 2.

Effects of antenna 10 and converter 13 are specifically described below. While a converter 13 shown in FIG. 9 is basically the same in structure as converter 13 shown in FIGS. 1 and 2, the former and latter converters are different from each other in that a dielectric antenna 33 and a waterproof cover 44 of the former converter are different in structure from those of the latter. Specifically, for converter 13 shown in FIG. 9, dielectric antenna 33 is mounted to close an opening of a waveguide 2. Waterproof cover 44 is mounted to cover dielectric antenna 33 while connected to chassis body 1. The connecting portion of waterproof cover 44 and chassis body 1 is basically the same in structure as the connecting portion of chassis body 1 and waterproof cover 4 of converter 13 shown in FIGS. 1 and 2. Specifically, for converter 13 shown in FIG. 9, a nail portion 21 of waterproof cover 44 and the sidewall of a flange portion 20 of chassis body 1 fit with each other to fix waterproof cover 44 to chassis body 1. Pressed toward waveguide 2 by this waterproof cover 44, dielectric antenna 33 is fixed.

Regarding converter 13 shown in FIG. 9, waterproof cover 44 is used as described above to tightly attach dielectric antenna 33 to chassis body 1 where waveguide 2 is formed. Therefore, if the shape of dielectric antenna 33 is changed, the shape of waterproof cover 44 has to be changed as well. Thus, in the case where converters 13 are mounted respectively on two types of parabolic antennas different from each other for example in angular aperture and FD ratio, two types of radiation patterns of the feedhorn are also necessary. Thus, in order to provide different radiation patterns, it is necessary to provide dielectric antennas 33 of two types different in shape. In this case, for converter 13 of the comparative example shown in FIG. 9, it is required to produce dielectric antennas 33 of two different types in shape, and it is also required to produce waterproof covers 44 of two different types in shape. As a result, such a cost as the cost for manufacturing molds for waterproof covers 44 becomes necessary, resulting in an increase in manufacturing cost of converter 13.

Further, converter 13 shown in FIG. 9 has an impedance matching portion 45 on the rear side of dielectric antenna 3 (on the side facing the inside of waveguide 2). Consequently, the thickness of dielectric antenna 33 increases, resulting in a problem of deterioration in injection moldability of dielectric antenna 33. Therefore, in the case where the injection molding is used to manufacture dielectric antenna 33, such defects as sink mark and generation of air bubbles therein could occur.

In contrast, converter 13 of the present invention shown in FIGS. 1 and 2 has dielectric antenna 3 mounted to be attachable to and detachable from the outside of waterproof cover 4, and thus converters 13 having respective radiation patterns respectively appropriate for parabolic antennas different from each other in aperture angle and FD ratio can easily be implemented merely by changing the shape of dielectric antenna 3 (while the shape of waterproof cover 4 is unchanged).

Further, converter 13 shown in FIGS. 1 and 2 has impedance matching portion 40 that is conical in shape and mounted on the rear side of waterproof cover 4 (the side facing waveguide 20). Such an impedance matching portion 40 can be mounted to reduce occurrences of reflected waves between waveguide 2 and waterproof cover 4. Furthermore, since such an impedance matching portion is mounted on waterproof cover 4, it is unnecessary to provide a separate impedance matching portion to dielectric antenna 3. Accordingly, the thickness of dielectric antenna 3 can be made smaller than that of dielectric antenna 33 shown in FIG. 9. Thus, the injection moldability of dielectric antenna 3 can be improved.

Regarding converter 13 shown in FIGS. 1 and 2, as a structure of the connecting portion connecting dielectric antenna 3 and water proof cover 4 to each other, any arbitrary structure may be employed under the condition that dielectric antenna 3 can be detachably connected to (can be connected to be attachable to and detachable from) waterproof cover 4. A description is hereinafter given of exemplary structures of this connecting portion.

Figure 3:
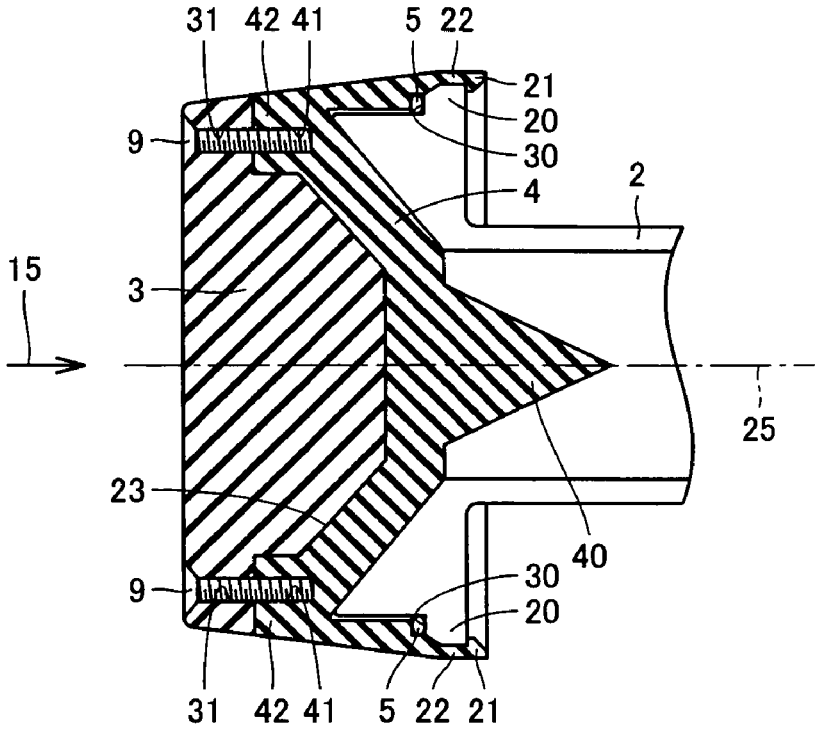
FIG. 3 is a schematic cross-sectional view showing a first example of the structure of a connecting portion connecting a dielectric antenna and a waterproof cover of the converter shown in FIGS. 1 and 2.
Figure 4:
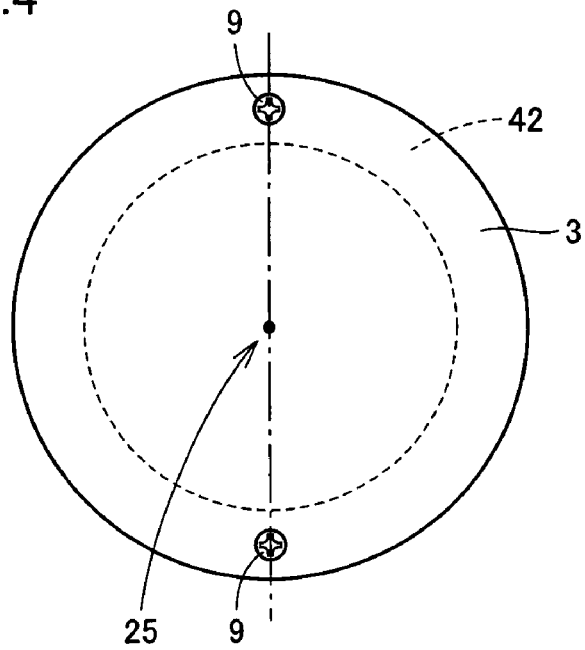
FIG. 4 is a front view showing an example of a front portion of a dielectric feedhorn of the converter, as seen in the direction indicated by an arrow in FIG. 3.

In conjunction with FIGS. 3 and 4, a first example of the structure of the connecting portion connecting dielectric antenna 3 and waterproof cover 4 of the converter is descibed.

As shown in FIGS. 3 and 4, the first example of the structure of the connecting portion connecting dielectric antenna 3 and waterproof cover 4 of converter 13 uses screws made of a resin to detachably connect and fix dielectric antenna 3 and waterproof cover 4 to each other. Specifically, in an external rim portion 42 of waterproof cover 4, a screw hole 41 is formed for a screw 9 to be inserted and fixed therein. As shown in FIG. 4, two screw holes 41 may be formed at respective positions symmetrical to each other with respect to central axis 25. In dielectric antenna 3, at respective positions overlying screw holes 41, holes 31 that are through holes are formed. Waterproof cover 4 and dielectric antenna 3 are placed to allow screw holes 41 of waterproof cover 4 and holes 31 of dielectric antenna 3 to overlie each other. In this state, screws 9 are inserted and fixed in holes 31 and screw holes 41. Accordingly, dielectric antenna 3 can be connected and fixed to waterproof cover 4. Further, when dielectric antenna 3 is to be detached from waterproof cover 4, screws 9 may be removed from holes 31 and screw holes 41 to easily remove dielectric antenna 3 from waterproof cover 4.

Figure 5:
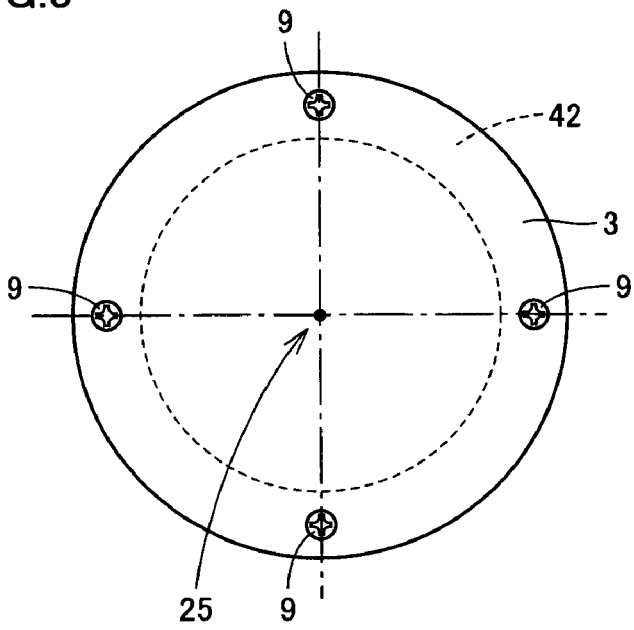
FIG. 5 is a front view showing another example of the front portion of the dielectric feedhorn of the converter, as seen in the direction indicated by the arrow in FIG. 3.

The arrangement of screws 9 is not limited to the one as shown in FIG. 4 where screws 9 are arranged at two locations. Alternatively, as shown in FIG. 5, screws 9 may be arranged respectively at four locations at even intervals with respect to central axis 25. At this time, in the region where screw 9 is placed, hole 31 that is a through hole is formed in dielectric antenna 3 and screw hole 41 is formed in external rim portion 42 of waterproof cover 4 as shown in FIG. 3. Further, regarding the arrangement of screws 9, the arrangement is not limited to the arrangement of screws 9 at four locations as shown in FIG. 5 and screws may be arranged arbitrarily at an arbitrary number of locations, like three or more or five or more locations. Preferably, the diameter of screw hole 41 and hole 31 is at least 2 mm and at most 3 mm.

Figure 6:
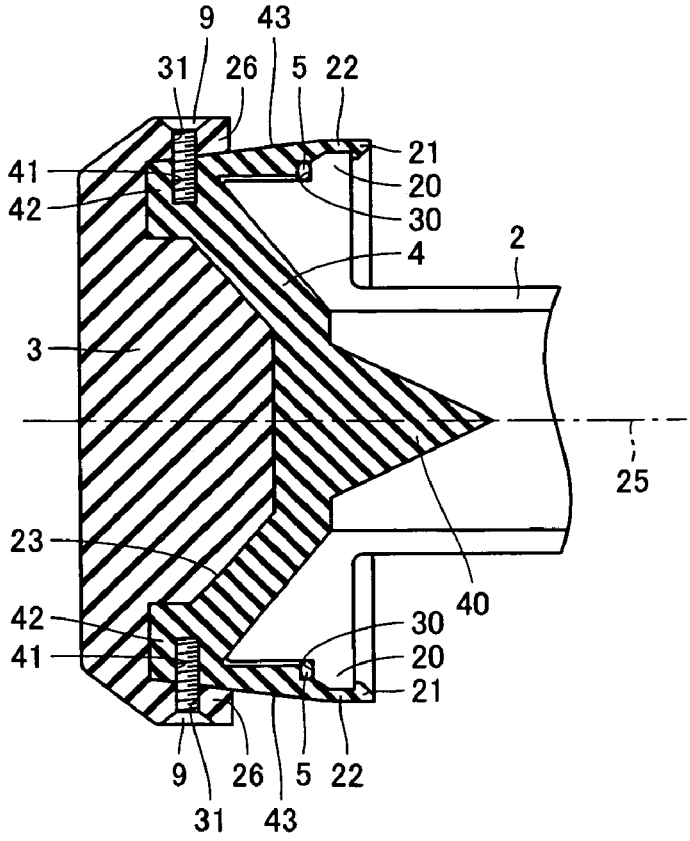
FIG. 6 is a schematic cross-sectional view illustrating a second example of the structure of the connecting portion connecting the dielectric antenna and the waterproof cover.

Referring to FIG. 6, a second example of the structure of the connecting portion connecting the dielectric antenna and the waterproof cover of the converter is described. FIG. 6 corresponds to FIG. 3.

The feedhorn portion of converter 13 shown in FIG. 6 is basically the same as the feedhorn shown in FIG. 3 in that dielectric antenna 3 and waterproof cover 4 are connected and fixed to each other by means of screws 9 made of a resin, plastic for example. The feedhorn portion in FIG. 6, however, differs from that shown in FIG. 3 in arrangement of screws 9. Specifically, screw hole 41 is formed in the external sidewall of external rim portion 42 of waterproof cover 4. Screw hole 41 extends from a side surface 43 of external rim portion 42 toward central axis 25. Further, dielectric antenna 3 has an extending portion 26 extending over side surface 43 of external rim portion 42 of waterproof cover 4. In this extending portion 26, hole 31 is formed at the position overlying screw hole 41 of waterproof cover 4. This hole 31 also extends from extending portion 26 of dielectric antenna 3 toward central axis 25.

Dielectric antenna 3 is mounted on the outside of waterproof cover 4 in the state where hole 31 of dielectric antenna 3 overlies screw hole 41 of waterproof cover 4. Then, plastic screw 9 is inserted and fixed in this hole 31 and screw hole 41. In this way, waterproof cover 4 and dielectric antenna 3 are connected and fixed to each other.

Figure 7:
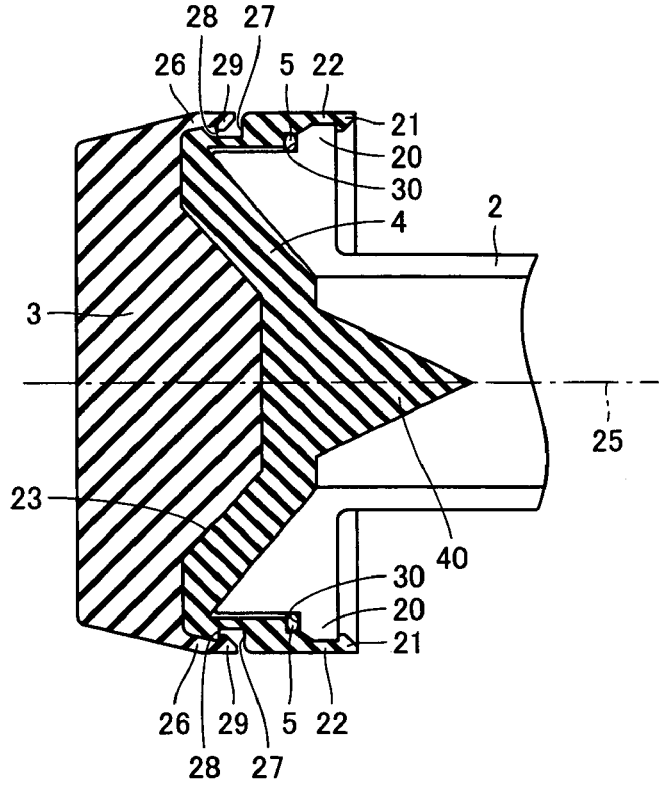
FIG. 7 is a schematic cross-sectional view illustrating a third example of the structure of the connecting portion connecting the dielectric antenna and the waterproof cover of the converter.

Referring to FIG. 7, a third example of the structure of the connecting portion connecting dielectric antenna 3 and waterproof cover 4 of the converter is described. FIG. 7 corresponds to FIG. 3.

Regarding the feedhorn portion of converter 13 shown in FIG. 7, a nail portion 29 formed on a rear end of the external periphery of dielectric antenna 3 fits with a stepped portion 28 formed on the external side surface of waterproof cover 4 so as to detachably connect and fix dielectric antenna 3 and waterproof cover 4 to each other. Specifically, in the external sidewall of waterproof cover 4, a depression 27 in the shape of a groove is formed to extend in the circumferential direction with the center of circumference at central axis 25. Instead of providing this depression 27 all around the external sidewall of waterproof cover 4, depressions 27 may be formed at respective separate positions.

Dielectric antenna 3 has an extending portion 26 extending onto the external sidewall of waterproof cover 4. On an end of this extending portion 26 (the end closer to waveguide 2), nail portion 29 (nail portion 29 projecting toward central axis 25) is formed. This nail portion 29 fits with stepped portion 28 formed on the external sidewall of waterproof cover 4 (stepped portion 28 formed by the sidewall of depression 27 formed in the external sidewall of water proof cover 4 and the external sidewall of waterproof cover 4), and thus dielectric antenna 3 is detachably fixed to waterproof cover 4. In this way, without such additional members as screws, dielectric antenna 3 can easily be connected and fixed to waterproof cover 4. In contrast to the structure shown in FIG. 7, a depression may be formed in dielectric antenna 3 and a protrusion may be formed on waterproof cover 4 to allow the protrusion to fit in the depression and thereby connect and fix dielectric antenna 3 to waterproof cover 4.

Figure 8:
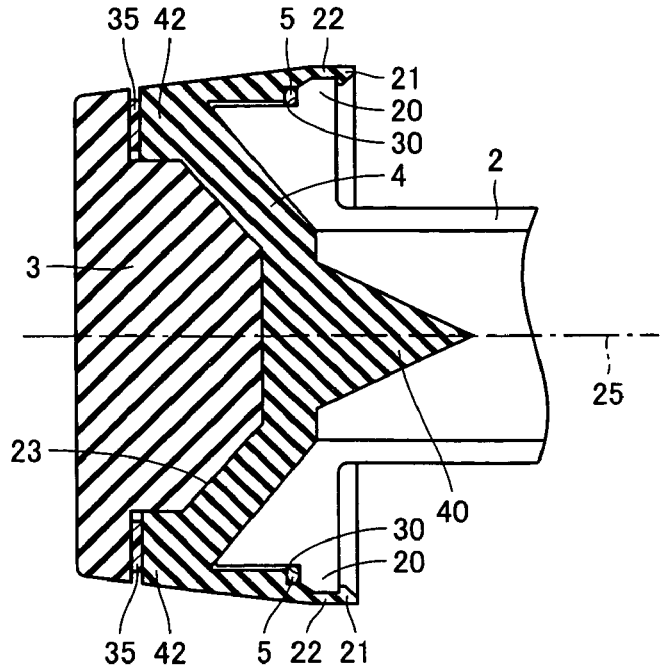
FIG. 8 is a schematic cross-sectional view illustrating a fourth example of the structure of the connecting portion connecting the dielectric antenna and the waterproof cover of the converter.

Referring to FIG. 8, a fourth example of the structure of the connecting portion connecting dielectric antenna 3 and waterproof cover 4 of the converter is described.

For the converter shown in FIG. 8, an adhesive member 35 like a double-stick tape for example is placed between respective surfaces of dielectric antenna 3 and waterproof cover 4 that are opposite to each other. This adhesive member 35 is used to connect and fix dielectric antenna 3 and waterproof cover 4 to each other. Preferably, adhesive member 35 is at most 50 μm in thickness. As adhesive member 35, an arbitrary member may be employed such as a double-stick tape having adhesive layers formed on both sides of a tape-shaped base member or an adhesive.

In addition to the structures of the connecting portion as described above, any arbitrary connecting method, thermo-compression bonding, for example, may be employed for the connecting portion connecting dielectric antenna 3 and waterproof cover 4.

Further, instead of connecting and fixing dielectric antenna 3 to waterproof cover 4 as described above, dielectric antenna 3 may be connected to chassis body 1. For example, dielectric antenna 3 may have an extending portion extending from a portion on the sidewall of waterproof cover 4 to the portion on the sidewall of chassis body 1 and a leading end portion of the extending portion and the sidewall of chassis body 1 may be connected and fixed to each other. As a method for this connection, the aforementioned method of connection by means of screws (see FIG. 6) or the method of connection to allow the protrusion to fit in the depression (see FIG. 7) may be employed.

Characteristic structural examples of the present invention are hereinafter described one by one, while some may be similar to characteristics of the above-described embodiment.

According to an example embodiment, the feedhorn includes chassis body 1, waterproof cover 4 serving as a cover member and dielectric antenna 3. Chassis body 1 includes waveguide 2 having an opening. Waterproof cover 4 is connected to chassis body ito cover the opening. Waterproof cover 4 is made of a dielectric. Dielectric antenna 3 is placed to face the opening with waterproof cover 4 therebetween.

Thus, in the case where the shape of dielectric antenna 3 is changed for changing the radiation pattern of the feedhorn, the structure of waterproof cover 4 employed for dielectric antenna 3 before changed in shape may be used as it is under the condition that the shape of the connecting portion of dielectric antenna 3 that is a portion for connecting to waterproof cover 4 is not changed. In other words, a common waterproof cover 4 may be used for dielectric antennas 3 of different shapes. Accordingly, as compared with the case where waterproof covers 4 of different shapes that are appropriate for respective different shapes of dielectric antennas 3 are formed, the cost for molds for example can be reduced. The manufacturing cost of the feedhorn can thus be reduced.

Regarding the above-described feedhorn, waterproof cover 4 and dielectric antenna 3 may be made of the same material. In this case, mismatching between waterproof cover 4 and dielectric antenna 3 can be prevented.

Regarding the above-described feedhorn, waterproof cover 4 may include impedance matching portion 40 located inside the opening. Regarding the aforementioned feedhorn, impedance matching portion 40 is a conical portion formed to protrude, from a surface of waterproof cover 4 that faces the opening, toward the inside of waveguide 2.

In this case, occurrences of reflected waves between waveguide 2 and waterproof cover 4 can be reduced. Consequently, deterioration in radiation characteristics of the feedhorn can be prevented. Further, since waterproof cover 4 has impedance matching portion 40 formed, it is unnecessary for dielectric antenna 3 to have such an impedance matching portion formed. Therefore, it does not occur that the thickness of dielectric antenna 3 increases due to an impedance matching portion formed thereon. Thus, the thickness of the central portion of dielectric antenna 3 can be at most 8 mm for example. By providing the thickness of the central portion of dielectric antenna 3 that is at most 8 mm, air bubbles, if generated in the manufacturing process at the central portion of dielectric antenna 3, have a diameter of approximately 3 mm or smaller. Air bubbles with the diameter of 3 mm or less have small influences on the radiation characteristics of the feedhorn and thus deterioration in radiation characteristics can be prevented.

Regarding the feedhorn described above, preferably dielectric antenna 3 is detachably connected to waterproof cover 4. In this case, by replacement of dielectric antenna 3, feedhorns having dielectric antennas 3 of different types can easily be implemented.

As shown in FIGS. 3 and 6, regarding the above-described feedhorn, screw hole 41 may be formed, as a cover member's screw hole, in waterproof cover 4, while dielectric antenna 3 may have a portion that is opposite to screw hole 41 and that is a portion where hole 31 is formed as an antenna's screw hole, so that screw 9 provided as a fixing screw may be inserted into the hole. Screw 9 may be inserted and fixed in screw hole 41 and hole 31 to connect waterproof cover 4 and dielectric antenna 3 to each other. In this case, screw 9 can be used to easily connect and fix waterproof cover 4 and dielectric antenna 3 to each other. Further, screw 9 can be detached to easily detach dielectric antenna 3 from waterproof cover 4.

As shown in FIGS. 3 to 6, regarding the above-described feedhorn, preferably screw hole 41 and hole 31 are placed at a position that does not coincide with the opening of waveguide 2 as seen from dielectric antenna 3 toward the opening of waveguide 2 (placed at external rim portion 42). In this case, the degree of change in radiation characteristics of the feedhorn that occurs due to the placement of screw 9 can be made small.

Preferably, the aforementioned screw 9 is made of a resin. In this case, as compared with the case where a metal screw is employed, influences on radiation characteristics of the feedhorn can be reduced.

Regarding the above-described feedhorn, as shown in FIG. 7, nail portion 29 that is a protrusion may be formed on one of waterproof cover 4 and dielectric antenna 3. Further, preferably, in the other of waterproof cover 4 and dielectric antenna 3, depression 27 may be formed at a position opposite to nail portion 29. Preferably, nail portion 29 fits in depression 27 to connect waterproof cover 4 and dielectric antenna 3 to each other. In this case, without such an additional member as fixing screw, dielectric antenna 3 can be connected to waterproof cover 4. Thus, the manufacturing cost of the feedhorn can be prevented from increasing.

Regarding the above-described feedhorn, preferably nail portion 29 and depression 27 are formed at a portion located on the sidewall of waveguide 2. In this case, there can be lower possibility of influences of nail portion 29 and depression 27 over the radiation characteristics of the feedhorn.

According to the present tecnology, a radio wave receiving converter includes the above-described feedhorn. Thus, the feedhorn with which the manufacturing cost can be reduced is employed and accordingly the manufacturing cost of the radio wave receiving converter can also be reduced.

According to the present tecnology, an antenna has the above-described radio wave receiving converter. Thus, the radio wave receiving converter of low manufacturing cost is employed, and consequently the manufacturing cost of the antenna can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A feedhorn comprising:

a chassis body comprising wave guide having an opening;

a cover member comprising a dielectric and connected to said waveguide and to said chassis body to cover said opening; and a dielectric antenna placed to be opposite to said opening with said cover member therebetween.

2. The feedhorn according to claim 1, wherein said cover member and said dielectric antenna are made of the same material.

3. The feedhorn according to claim 1, wherein said cover member includes an impedance matching portion located inside said opening.

4. The feedhorn according to claim 1, wherein said dielectric antenna is detachably connected to said cover member.

5. The feedhorn according to claim 4, wherein said cover member comprises a cover-member screw-hole formed therein, said dielectric antenna comprises antenna screw-hole formed at a portion opposite to said cover-member screw-hole for a fixing screw to be inserted, and the fixing screw is inserted and fixed in said cover-member screw-hole and said antenna screw-hole to connect said cover member and said dielectric antenna to each other.

6. The feedhorn according to claim 4, wherein one of said cover member and said dielectric antenna comprises a protrusion formed thereon, the other of said cover member and said dielectric antenna comprises a depression formed at a portion opposite to said protrusion, and said protrusion fits in said depression to connect said cover member and said dielectric antenna to each other.

7. A radio wave receiving converter having the feedhorn as recited in claim 1.

8. An antenna having the radio wave receiving converter as recited in claim 7.

9. A feedhorn comprising:

a chassis body comprising a waveguide having an opening;

a cover member comprising a dielectric and connected to said chassis body to cover said opening; and a dielectric antenna placed to be opposite to said opening with said cover member therebetween;

wherein said cover member comprises an impedance matching portion located inside said opening.

10. The feedhorn according to claim 9, wherein said cover member and said dielectric antenna are made of the same material.

11. The feedhorn according to claim 9, wherein said dielectric antenna is detachably connected to said cover member.

12. The feedhorn according to claim 11, wherein said cover member comprises a covermember screwhole formed therein, said dielectric antenna comprises an antenna screw-hole formed at a portion opposite to said cover-member screw-hole for a fixing screw to be inserted, and the fixing screw is inserted and fixed in said cover-member screw-hole and said antenna screw-hole to connect said cover member and said dielectric antenna to each other.

13. The feedhorn according to claim 11, wherein one of said cover member and said dielectric antenna comprises a protrusion formed thereon, the other of said cover member and said dielectric antenna comprises a depression formed at a portion opposite to said protrusion, and said protrusion fits in said depression to connect said cover member and said dielectric antenna to each other.

14. A radio wave receiving converter having the feedhorn as recited in claim 9.

15. An antenna having the radio wave receiving converter as recited in claim 13.

16. A feedhorn comprising:

a chassis body comprising a waveguide having an opening;

a cover member comprising a dielectric and connected to said chassis body to cover said opening; and a dielectric antenna placed to be opposite to said opening with said cover member therebetween;

wherein said dielectric antenna is detachably connected to said cover member;

wherein:

said cover member comprises a cover-member screw-hole formed therein, said dielectric antenna comprises an antenna screw-hole formed at a portion opposite to said cover-member screw-hole for a fixing screw to be inserted, and the fixing screw is inserted and fixed in said cover-member screw-hole and said antenna screw-hole to connect said cover member and said dielectric antenna to each other.

17. A feedhorn comprising:

a chassis body comprising a waveguide having an opening;

a cover member comprising a dielectric and connected to said chassis body to cover said opening; and a dielectric antenna placed to be opposite to said opening with said cover member therebetween;

wherein said dielectric antenna is detachably connected to said cover member;

wherein:

one of said cover member and said dielectric antenna comprises a protrusion formed thereon, the other of said cover member and said dielectric antenna comprises a depression formed at a portion opposite to said protrusion, and said protrusion fits in said depression to connect said cover member and said dielectric antenna to each other.

* * * * *